US010421645B2

(12) United States Patent
Givens

(10) Patent No.: US 10,421,645 B2
(45) **Date of Patent: *Sep. 24, 2019**

(54) CRANE RAIL

(71) Applicant: Raymond D. Givens, London (CA)

(72) Inventor: Raymond D. Givens, London (CA)

( * ) Notice: Subject to any disclaimer, the term of this patent is extended or adjusted under 35 U.S.C. 154(b) by 373 days.

This patent is subject to a terminal disclaimer.

(21) Appl. No.: 15/431,928

(22) Filed: Feb. 14, 2017

(65) Prior Publication Data

US 2018/0229980 A1 Aug. 16, 2018

(51) Int. Cl.

| | |
|---|---|
| ***B66C 1/02*** | (2006.01) |
| ***B66C 7/02*** | (2006.01) |
| ***B66C 7/04*** | (2006.01) |
| ***B66C 9/02*** | (2006.01) |

(52) U.S. Cl.

CPC ..... *B66C 7/02* (2013.01); *B66C 7/04* (2013.01); *B66C 9/02* (2013.01)

(58) Field of Classification Search

CPC .. B66C 17/04; B66C 5/02; B66C 5/04; B66C 6/00; B66C 7/02; B66C 7/04; B66C 7/08; B66C 9/02

See application file for complete search history.

(56) References Cited

U.S. PATENT DOCUMENTS

| | | | | |
|---|---|---|---|---|
| 779,493 | A | 1/1905 | MoMyler | |
| 945,751 | A | 1/1910 | Butler | |
| 1,204,470 | A | 11/1916 | Miller | |
| 1,296,755 | A | 3/1919 | Buckley | |
| 1,515,023 | A * | 11/1924 | Fitch | B66C 19/002 104/126 |
| 3,062,340 | A | 11/1962 | Hunnebeck | |
| 4,202,529 | A | 5/1980 | Fitting | |
| 4,569,453 | A * | 2/1986 | Oustad | B66C 23/52 212/299 |

(Continued)

*Primary Examiner* — Emmanuel M Marcelo

(74) *Attorney, Agent, or Firm* — Brunet & Co. Ltd.

(57) ABSTRACT

An overhead crane has first and second runway rails that extend parallel to a generally horizontal runway axis and a bridge that extends along a bridge axis that is generally horizontal and perpendicular to the runway axis and that is movable on the runway rails along the runway axis. The bridge includes a first bridge reinforcement member preloaded under tension to provide an upward deflection of the bridge rail. The first bridge reinforcement member may have at least two upwardly extending struts and a common upper end where the at least two struts meet, the at least two struts having lower ends mechanically connected to the bridge rail at positions longitudinally spaced apart with respect to the bridge axis. The lower ends of the at least two struts are longitudinally translatable along the bridge rail to adjust the tension on the first bridge reinforcement member to thereby adjust the extent of upward deflection of the bridge rail. The bridge further includes a pair of second bridge reinforcement members extending between the upper end of the first bridge reinforcement member and mechanically connected to the bridge rail proximate the first and second outer ends, the second bridge reinforcement members loaded in compression. The runway rails may be constructed in a similar manner as the bridge rail.

20 Claims, 15 Drawing Sheets

(56) References Cited

U.S. PATENT DOCUMENTS

| | | | | |
|---|---|---|---|---|
| 5,022,542 | A * | 6/1991 | Beier | B66C 5/02 104/126 |
| 5,230,197 | A | 7/1993 | Hart | |
| 5,337,908 | A | 8/1994 | Beck, Jr. | |
| 5,385,249 | A | 1/1995 | Long, Jr. | |
| 5,443,151 | A | 8/1995 | Taylor | |
| 5,526,614 | A | 6/1996 | Huang | |
| 5,694,857 | A | 12/1997 | Taylor | |
| 5,921,415 | A | 7/1999 | Markelz | |
| 6,378,387 | B1 * | 4/2002 | Froom | G01M 5/0016 73/865.8 |
| 8,960,459 | B2 | 2/2015 | Givens | |
| 2002/0084238 | A1 | 7/2002 | Zingerman | |
| 2011/0180507 | A1 * | 7/2011 | Givens | B66C 5/02 212/312 |
| 2011/0247993 | A1 * | 10/2011 | Chernyak | B66C 6/00 212/324 |

* cited by examiner

CRANE RAIL

FIELD

This application relates to overhead cranes for use in industrial plants, and more particularly to an overhead crane that is configured to lift a load using motorized means, but wherein an operator manually pulls or pushes the lifted load to its destination.

BACKGROUND

Overhead cranes typically include a pair of runways, which may be mounted fixedly to the roof joists of an industrial plant, a bridge that includes one or more bridge rails which have rollers at their ends for rolling along the runway rails, and a trolley which has rollers thereon for rolling along the one or more bridge rails. A hoist or some other lifting device is provided on the trolley for lifting a load.

For cranes having capacities of more than 4000 pounds, I-beam crane rails are typically used for the one or more bridge rails and for the runways. For cranes having capacities of less 4000 pounds, enclosed track crane rails, such as the crane rail shown at 100 in FIG. 1 are typically used.

A particular category of cranes is referred to as 'light' cranes, and typically have a capacity of about 2000 pounds or less. Light cranes typically do not have tractor drives on the bridge and trolley, which means that the load, once lifted off the plant floor, is moved around manually by the crane operator.

For such cranes, the weight of the bridge rails directly impacts the effort that the operator is required to exert when moving the lifted load to its destination. It is thus generally desirable to reduce the weight of the bridge rails. By reducing their weight, the effort required to move a given size of lifted load can be reduced.

A typical enclosed bridge rail is shown in FIG. 1. One method that has been used to reduce the weight of the bridge rail is to manufacture the bridge rail out of aluminum.

Another way has been disclosed in U.S. Pat. No. 8,960,459 issued on Feb. 25, 2015 to Givens.

It would be desirable to find other ways of reducing the weight of the bridge rail while reducing the possibility that the bridge rail may twist when loaded, particularly for light cranes that lack tractor drives for moving the bridge on the runways.

SUMMARY

In a first aspect, the invention is directed to an overhead crane, comprising: first and second runway rails that extend parallel to a generally horizontal runway axis; a bridge that extends along a bridge axis that is generally horizontal and perpendicular to the runway axis and that is movable on the runway rails along the runway axis, wherein the bridge includes a bridge rail having first and second ends and rolling structures at the first and second ends which are rollably supported on the first and second runway rails; a trolley having a plurality of trolley wheels thereon permitting movement of the trolley along the bridge rail; and a lifting device for holding a load, wherein the lifting device is supported by the trolley, wherein the bridge further includes a first bridge reinforcement member pre-loaded under tension to provide an upward deflection of the bridge rail, the first bridge reinforcement member comprising at least two upwardly extending struts and a common upper end where the at least two struts meet, the at least two struts having lower ends mechanically connected to the bridge rail at positions longitudinally spaced apart with respect to the bridge axis, the lower ends of the at least two struts longitudinally translatable along the bridge rail to adjust the tension on the first bridge reinforcement member to thereby adjust the extent of upward deflection of the bridge rail, a single pair of second bridge reinforcement members extending between the upper end of the first bridge reinforcement member and mechanically connected to the bridge rail proximate the first and second outer ends, the second bridge reinforcement members loaded in compression, and the bridge reinforcement members providing the greatest increase in bending strength at the longitudinal center of the bridge rail.

In another aspect, the invention is directed to a retrofit kit that permits the reinforcing structure described above to be easily retrofitted to existing bridge rails without the need for welding and without the need to install an inordinate quantity of fasteners.

In another aspect, there is provided a bridge or runway for an overhead crane, the bridge or runway comprising: a rail; a first reinforcement member pre-loaded under tension to provide an upward deflection of the rail, the first reinforcement member comprising at least two upwardly extending struts and a common upper end where the at least two struts meet, the at least two struts having lower ends mechanically connected to the rail at positions longitudinally spaced apart with respect to a longitudinal axis of the rail, the lower ends of the at least two struts longitudinally translatable along the rail to adjust the tension on the first reinforcement member to thereby adjust the extent of upward deflection of the rail; and, a single pair of second reinforcement members extending between the upper end of the first reinforcement member and mechanically connected to the rail proximate the first and second outer ends, the second reinforcement members loaded in compression.

Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1:
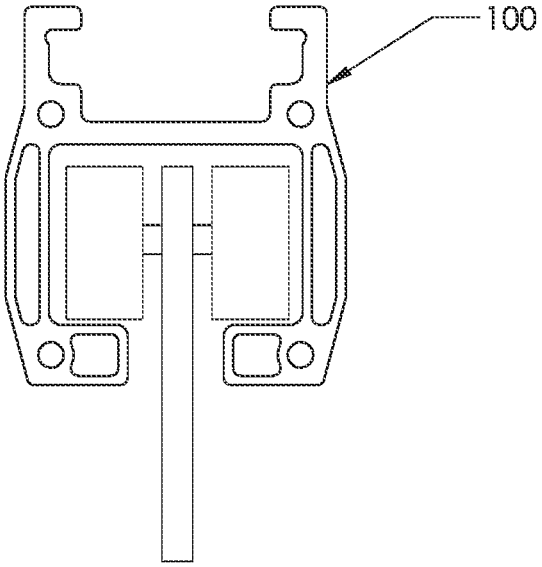
FIG 1 (PRIOR ART)
FIG. 1 is an end view of a bridge rail used in a crane in accordance with the prior art.
Figure 2:
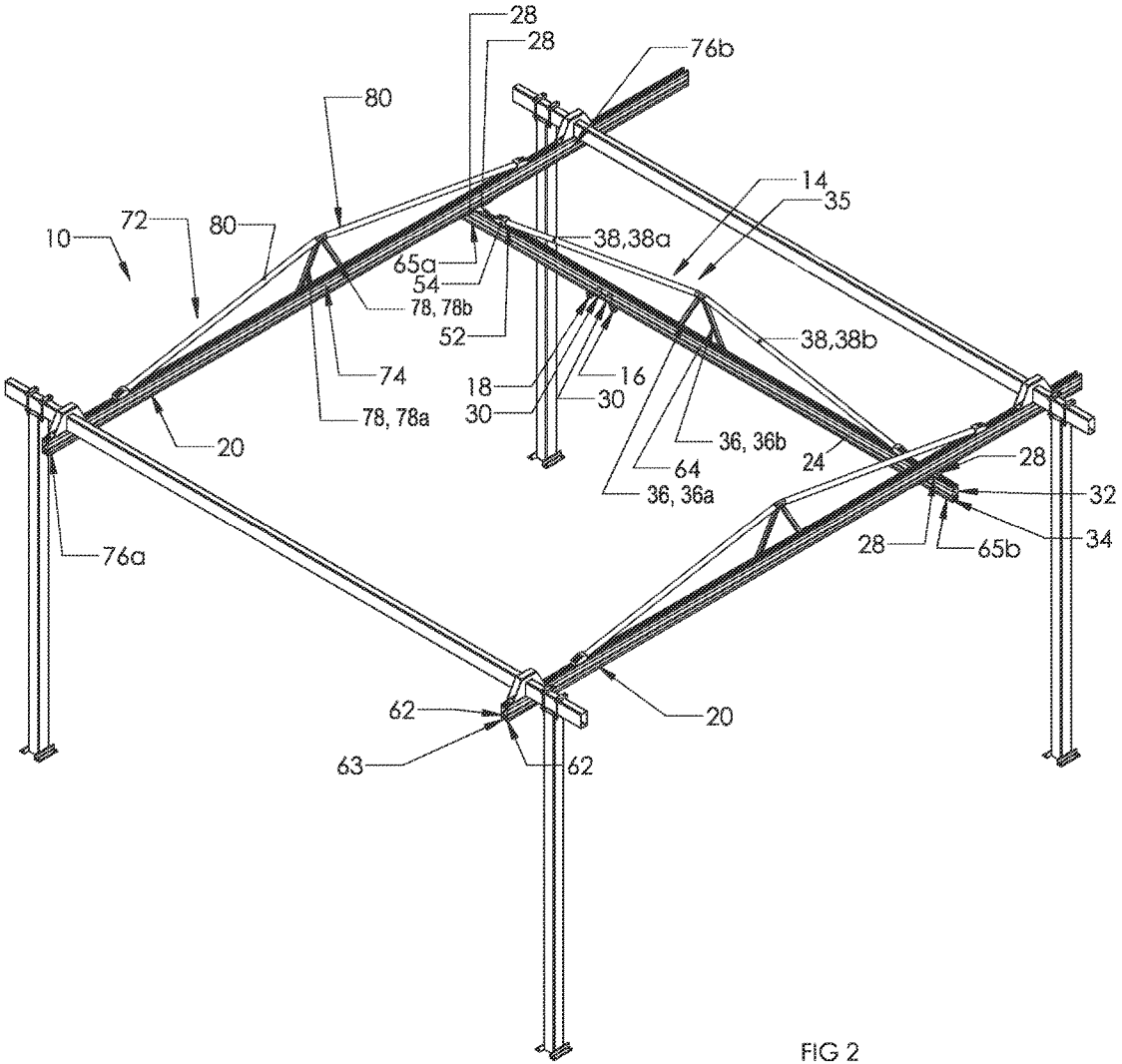
FIG. 2 is a perspective view of an overhead crane including a bridge in accordance with an embodiment of the present invention.

Reference is made to FIG. 2, which shows an overhead crane 10 in accordance with an embodiment of the present invention. The overhead crane 10 includes a pair of runway rails 20, a bridge 14, a trolley 16 and a lifting device 18, such as a hoist. The runway rails 20 extend parallel to a generally horizontal runway axis. The bridge 14 is made up of a single bridge rail 24 that extends parallel along a generally horizontal bridge axis that is perpendicular to the runway axis. The bridge rail 24 is rollably supported on the runway rails 20 at each end by end trucks 28. The bridge 14 may be manually rollable along the runway rails 20 through the end trucks 28. Alternatively, a bridge drive motor may be provided (not shown) to drive the bridge 14 on the runway rails 20. The trolley 16 is rollably supported on the bridge rail 24 by means of trolley wheels 30. The trolley 16 may be manually rollable along the bridge rail 24. Alternatively, a trolley drive motor (not shown) may be provided to drive the trolley 16 along the bridge rail 24.

Figure 11:
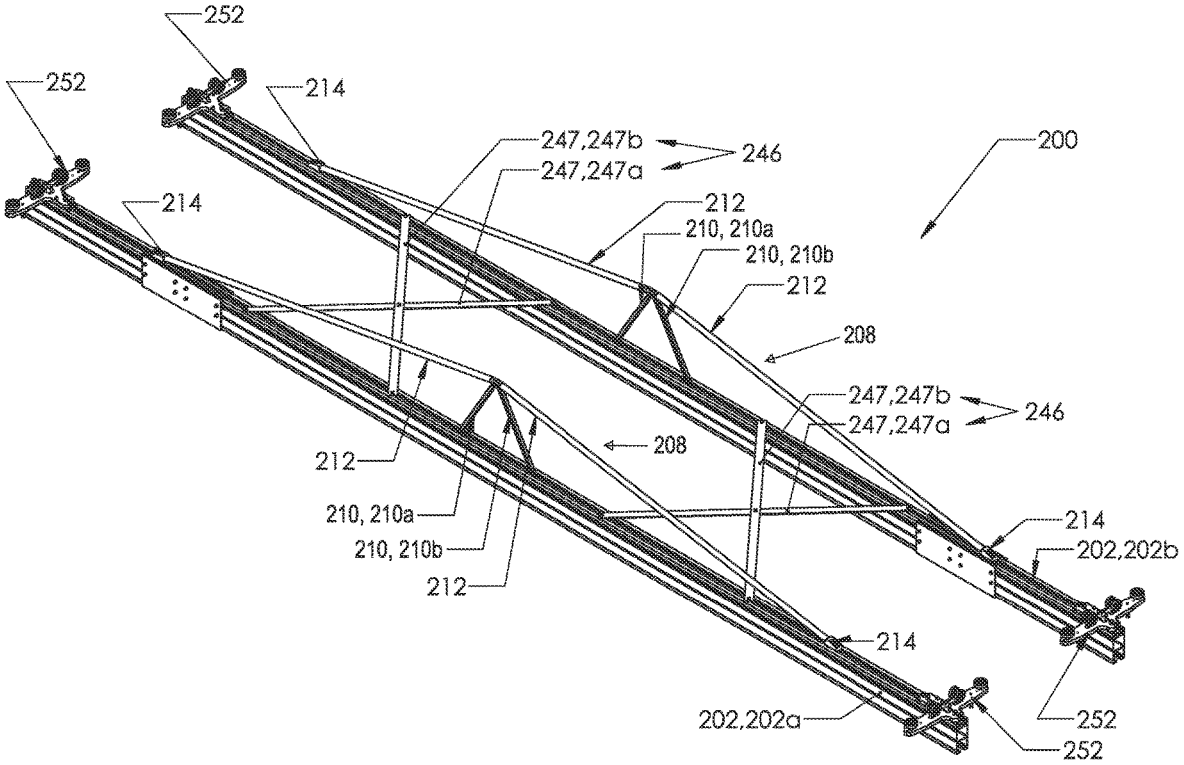
FIG. 11 is a perspective view of a double rail bridge that may be used with the overhead crane system shown in FIG. 2.

The bridge 14 shown in FIG. 2 has a single bridge rail 24. It will be noted that, in an alternative embodiment the bridge 14 could be provided with two or more bridge rails 24 (as shown in FIG. 11), and with a trolley that has wheels that roll along each bridge rail.

Figure 4:
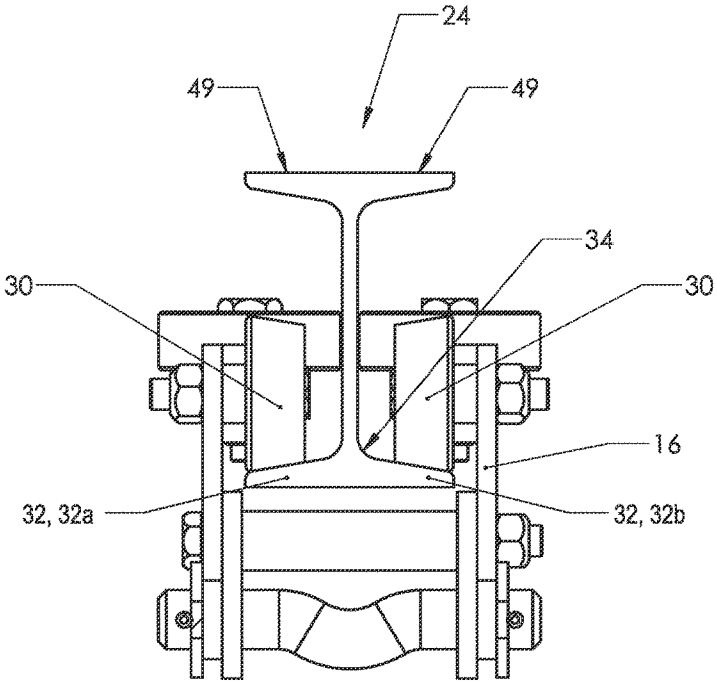
FIG. 4 is a magnified end view of an alternative bridge rail that could alternatively be part of the bridge shown in FIG. 2.
Figure 3:
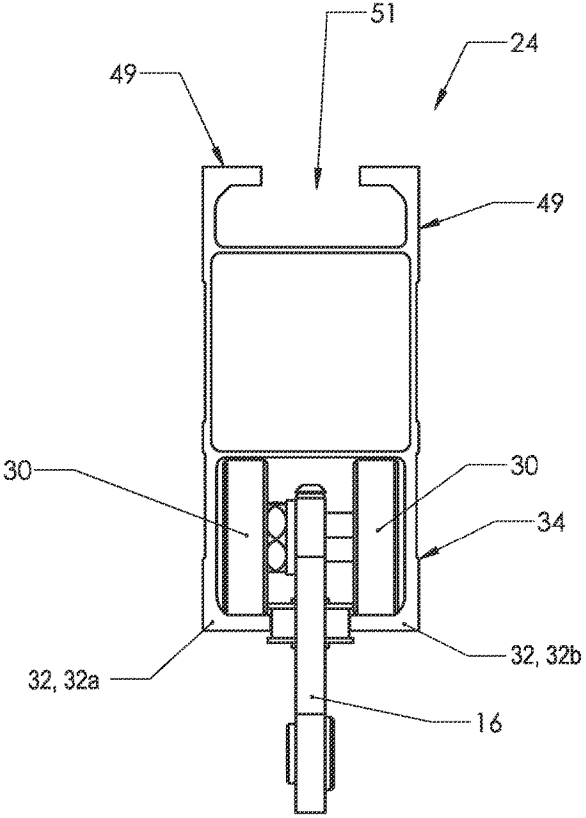
FIG. 3 is a magnified end view of a bridge rail that is part of the bridge shown in FIG. 2.
Figures 5, 6, 7:
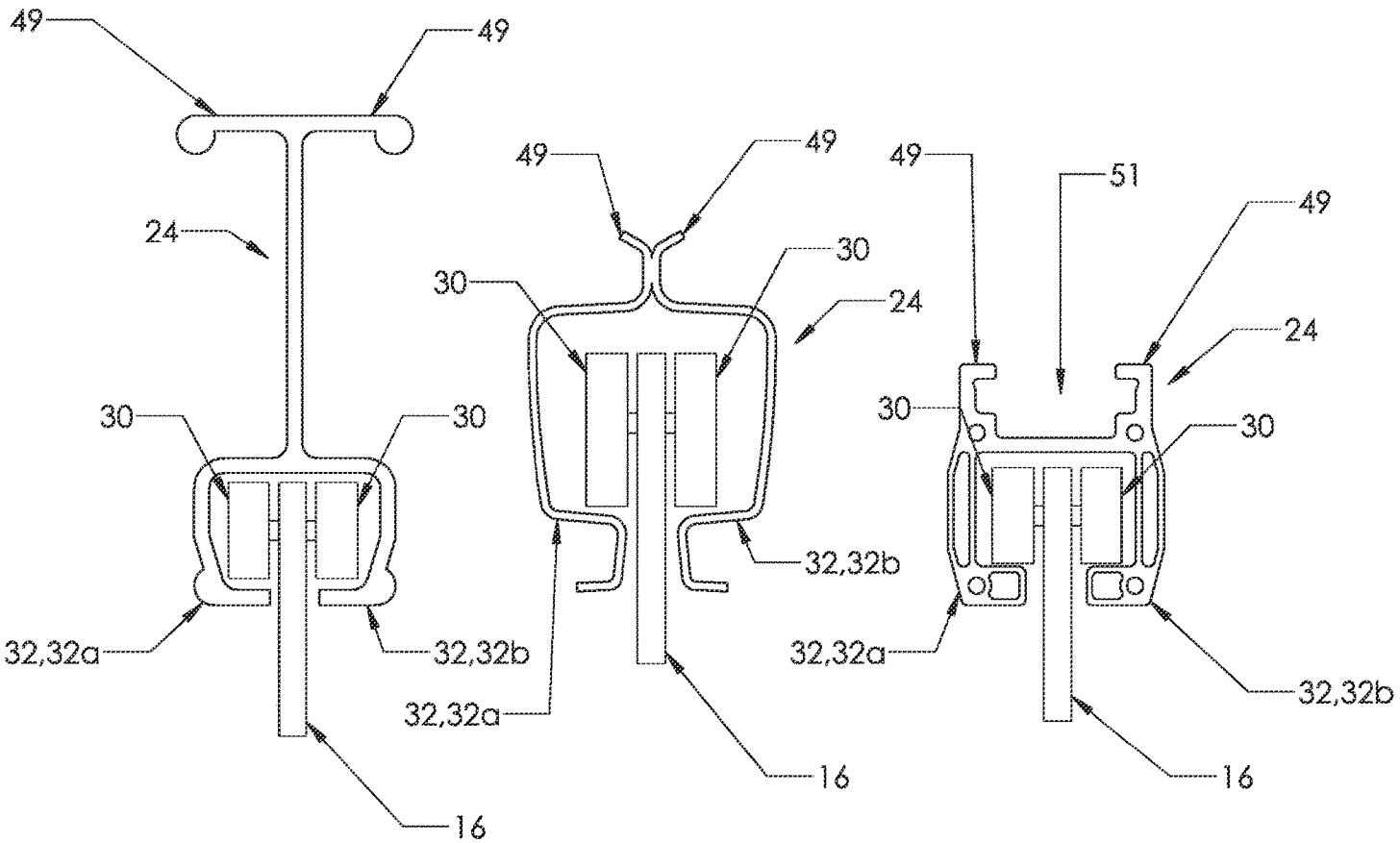
FIG. 5 is a magnified end view of another alternative bridge rail that could alternatively be part of the bridge rail shown in FIG. 2.
FIG. 6 is a magnified end view of another alternative bridge rail that could alternatively be part of the bridge rail shown in FIG. 2.
FIG. 7 is a magnified end view of another alternative bridge rail that could alternatively be part of the bridge rail shown in FIG. 2.

The bridge rail 24 in FIG. 2 has a pair of track flanges 32 (shown individually at 32*a* and 32*b*), which define a track 34 on which the trolley wheels 30 travel. The flanges 32 may be oriented towards each other so that the track 34 is an enclosed track as shown in FIG. 3. Alternatively, the flanges 32 may be oriented away from each other in which case the track 34 is an open track, as shown in FIG. 4. Other suitable shapes for the bridge rail 24 are shown in FIG. 5, FIG. 6 and FIG. 7.

The bridge rail 24 may be made from any suitable material, such as aluminum. It will be understood that, throughout this disclosure, the term aluminum is intended to encompass both pure aluminum and aluminum alloys. By manufacturing the bridge rail 24 out of aluminum the bridge rail 24 is lighter than if it were manufactured from a material such as steel.

Referring to FIG. 2, the bridge 14 further includes a first bridge reinforcement member 36, and two second bridge reinforcement members 38 (shown individually at 38*a* and 38*b*). The first and second bridge reinforcement members 36 and 38 may be made from any suitable material, such as aluminum tubing. The tubing may be round, which provides increased resistance to buckling (which is advantageous for the members that are in compression—in this case, the second members 38).

The first bridge reinforcement member 36 may comprise two struts 36*a* and 36*b* connected together at a common upper end 50 of the reinforcement member 36. In some embodiments, more than two struts may be used. Lower ends of the struts 36*a* and 36*b* may be mounted to the bridge rail 24 at longitudinally spaced apart positions on the bridge rail 24. The struts 36*a* and 36*b* form an inverted V-shape between the upper end 50 of the first bridge reinforcement member 36 and the bridge rail 24. The struts 36*a* and 36*b* meet and form an angle A at the common upper end 50, as shown by dashed lines in FIG. 8.

Figure 8:
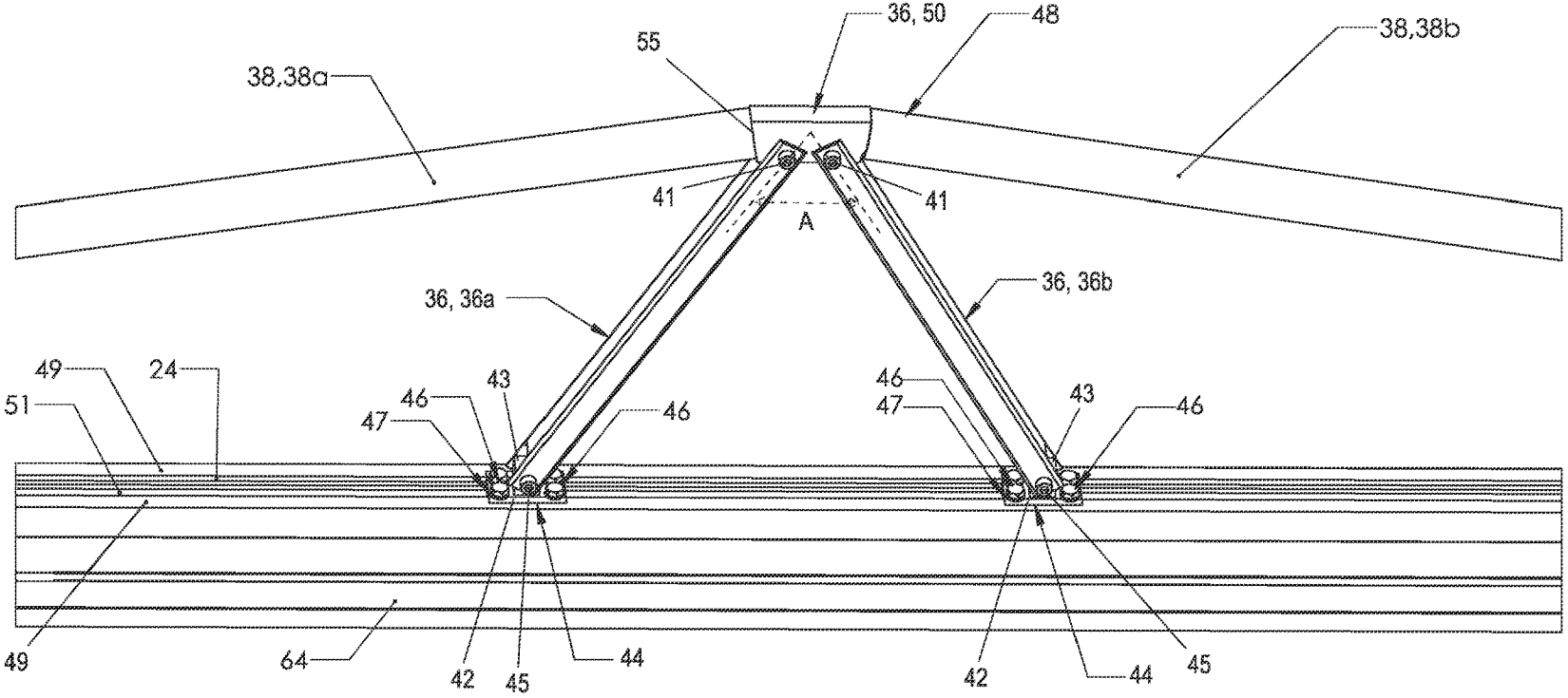
FIG. 8 is a magnified perspective view of the mounting of a first reinforcement member to the bridge rail shown in FIG. 2.

The first bridge reinforcement member 36 may be mounted to the bridge rail 24 in any suitable way, such as by a mechanical connection. For example, as shown in FIG. 8, the first bridge reinforcement member 36 may be provided with support flanges 42 at lower ends of the struts 36*a* and 36*b* shown at 44. The struts 36*a* and 36*b* may be mounted on respective support flanges 42 with pins 45, for example threaded fasteners such as bolt and nut fasteners, that pass through the lower ends 44 of the struts 36*a* and 36*b* and through respective mounting blocks 43 fixedly attached to the support flanges 42. Mechanical fasteners 46 (e.g. bolt and nut fasteners) may be provided that pass through the support flanges 42, through a slot 51 between a pair of flanges 49 on the bridge rail 24, and into first member clamping plates 47. When the fasteners 46 are tightened the two elements 42 and 47 together clamp the flanges 49 on the bridge rail 24 thereby fixing the first bridge reinforcement member 36 in position on the bridge rail 24. The second flanges 49 may be referred to as reinforcement support flanges as they support reinforcement structure 35.

Each second bridge reinforcement member 38 has a first end 48 that may be mechanically connected to the upper end (shown at 50) of the first bridge reinforcement member 36. For example, as shown in FIG. 8, the first ends 48 of the second reinforcement members 38 may pass through apertures 55 in the upper end 50 of the first member 36, Each aperture 55 may be referred to as a first member receiving aperture. The first ends 48 of the second reinforcement members 38 may be secured in the first member receiving apertures 55 by pins, for example threaded fasteners such as bolt and nut fasteners, that pass through the first member receiving apertures 55 and the first ends 48 of the second reinforcement members 38. Upper ends of the struts 36*a* and 36*b* may be secured to the common upper end 50 of the reinforcement member 36 by the pins 41.

Figure 9:
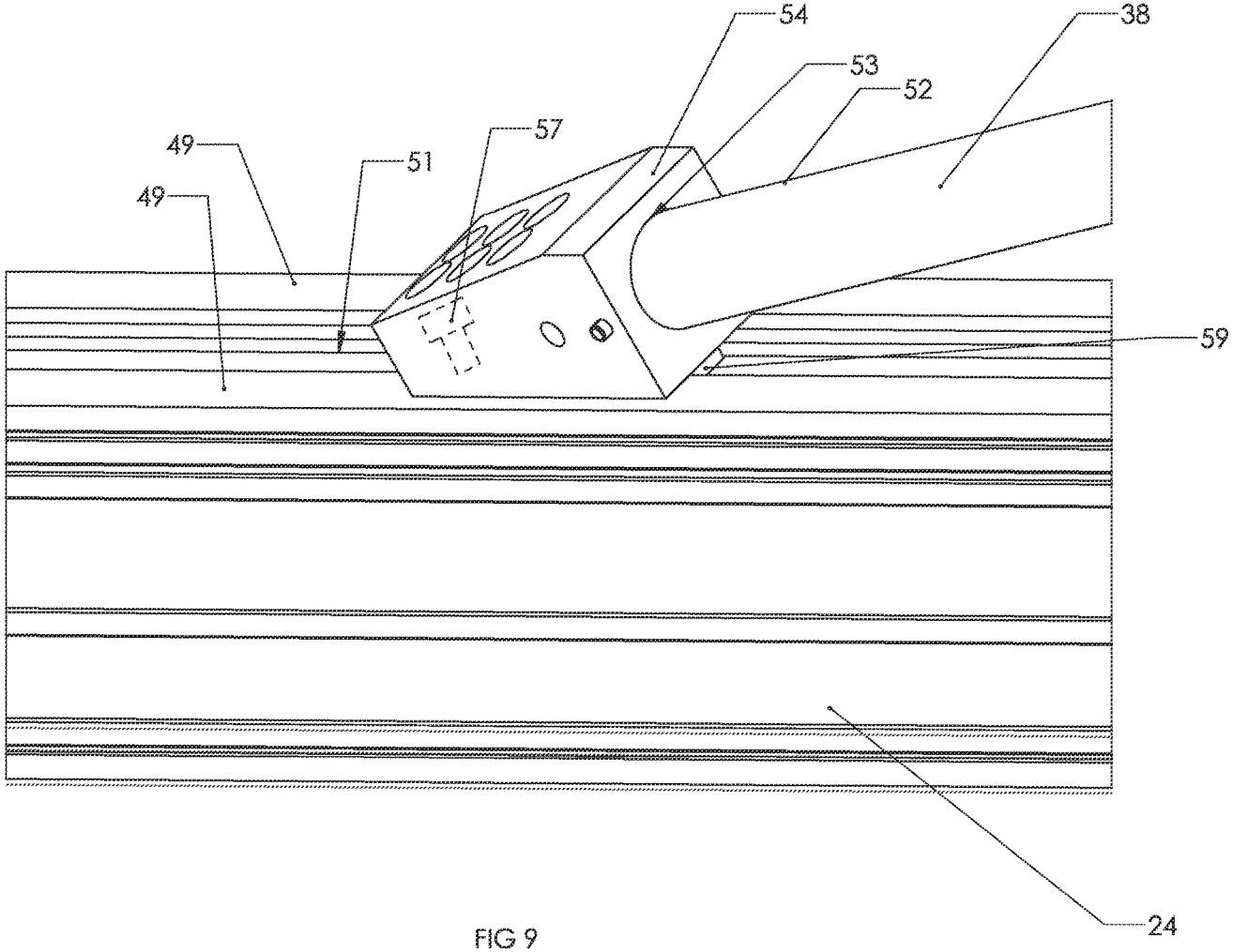
FIG. 9 is a magnified perspective view of the mounting of a second reinforcement member to the bridge rail shown in FIG. 2.
Figure 9A:
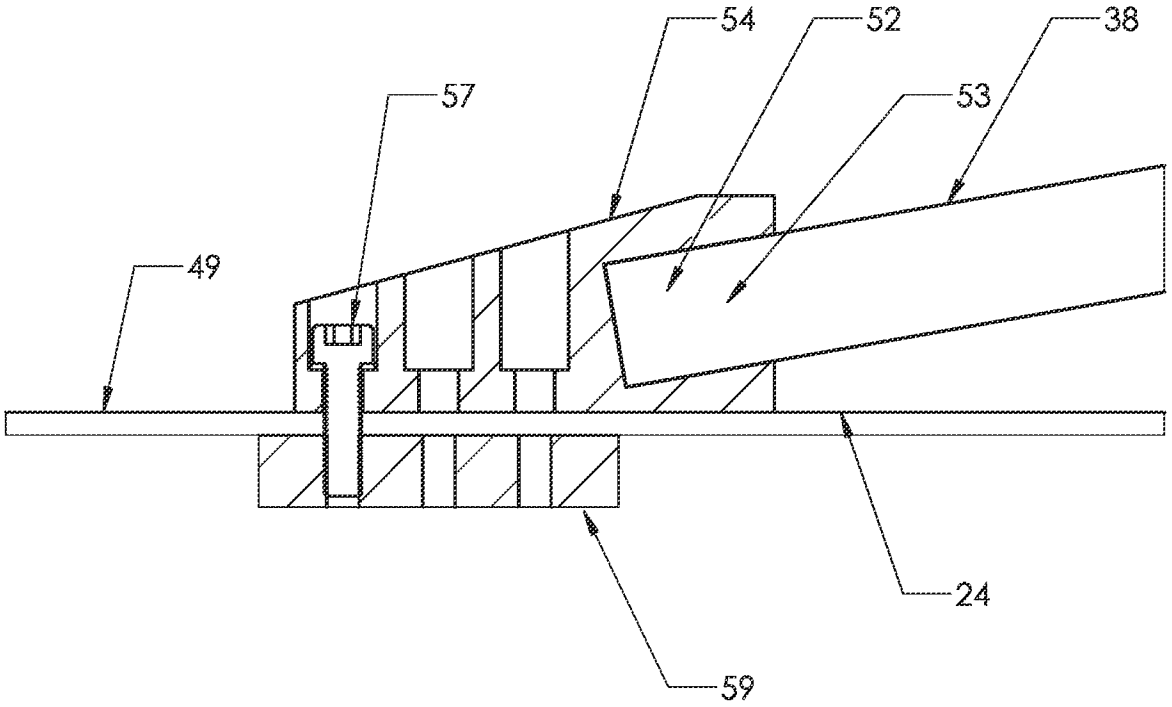
FIG. 9A is a magnified sectional view of a bracket shown receiving the second reinforcement member in FIG. 9.

Each second bridge reinforcement member 38 has a second end 52 (FIG. 9 and FIG. 9A) that may be inserted into a receiving aperture 53 in a bracket 54 on the upper portion of the bridge rail 24. The brackets 54 may be joined to the bridge rail 24 in any suitable way. For example, each bracket 54 may have one or more bracket mechanical fasteners 57 that pass through the bracket 54, through the slot 51 between the reinforcement support flanges 49 and into a bracket clamping plate 59. Tightening of the bracket mechanical fasteners 57 causes the bracket 54 and the bracket clamping plate 59 to clamp the flanges 49 on the bridge rail 24 to hold the bracket 54 in place during use. In FIG. 9A, only one of the upper flanges 49 is shown for simplicity.

The receiving aperture 53 may be a blind aperture with an end wall to support the second end 52 of the second bridge reinforcement member 38. The receiving aperture 53 may be referred to as a bracket receiving aperture 53.

During use with a chain type hoist on the trolley 16, the first member 36 is in tension and the second members 38 are in compression.

Referring to FIG. 2, the position of the first bridge reinforcement member 36 may be generally centered along the length of the bridge rail 24. The positions of the second ends 52 of the second bridge reinforcement members 38 may be proximate the ends of the bridge rail 24 while ensuring that the brackets 54 and the reinforcement members 38 do not interfere with the rolling of the bridge 14 along the runway rails 20.

The reinforcement members 36 and 38 together form a truss that is relatively simple and inexpensive to manufacture and that is relatively simple and quick to mount to the bridge rail 24 and is particularly advantageous in embodiments wherein the bridge rail 24 is made from aluminum. While mechanical joints are preferred for connecting the reinforcement members 36 and 38 to each other and to the bridge rail 24, particularly when all of these components are made from aluminum, it is nonetheless contemplated that these components could alternatively be welded together.

In general, welding to an aluminum bridge rail can be difficult to achieve without weakening the parent material that makes up the bridge rail. Use of mechanical fasteners instead to join reinforcement members to a bridge rail can be relatively time consuming however. Some proposed prior art reinforcement structures do not lend themselves to be joined to an aluminum bridge rail, since they entail joining to the bridge rail at many points, which would involve either many welds, which would weaken the bridge rail, or many mechanical fasteners, which would make the bridge rail prohibitively time consuming to manufacture.

The reinforcement structure 35 in FIG. 2 provides the greatest increase in bending strength to the bridge rail 24 at the longitudinal center of the bridge rail 24, shown at 64, which is also where the lifting device 18 exerts the greatest bending moments on the bridge rail 24. The amount of bending strength the reinforcement structure 35 provided to the bridge rail 24 decreases from the longitudinal center 64 toward the outer ends (which are shown at 65*a* and 65*b*). It will be noted that the increased resistance to bending provided by the reinforcement members 36 and 38 generally matches the bending moment profile of bending moments exerted by the lifting device 18 on the bridge rail 24 at different points along the bridge rail 24 while holding a load. As a result, the reinforcement members 36 and 38 are efficient in the sense that they provide the most strengthening to the portion of the bridge rail 24 that incurs the highest bending moments (i.e. the middle of the bridge rail 24).

By providing the reinforcement members 36 and 38, the bridge rail 24 can be made lighter than would otherwise be required if it consisted only of the bridge rail 24, for holding a selected size of load. This reduces the overall amount of weight that an operator must push or pull in embodiments wherein bridge drive motors are not provided. This is also advantageous in embodiments that do include drive motors for the bridge since the bridge drive motor (or motors) have less work to do to move the lighter bridge along the runway rails.

Another advantage to this configuration is that the bridge 14 has less momentum associated with it, and so the operator has a greater degree of control over stopping the bridge 14 after rolling the bridge 14 to a selected point along the runway rails 20. This is particularly relevant for bridges 14 that have relatively long spans, which are necessarily heavier and which have larger bending moments associated therewith resulting from the greater distances between their points of support on the runway rails and the load.

In another advantage, the first bridge reinforcement member 36 provides for less deflection of the bridge rail 24 under load, especially near the center of the bridge rail 24 compared to prior art crane rails. The first reinforcement member may be pre-tensioned thereby pre-loading the crane rail upward before any load is applied to the crane rail. Pre-loading the crane rail results in an upward deflection of the crane rail before any load is applied. As a load is applied, the crane rail will first flatten out and then deflect downward. When a load is applied to the crane rail, the maximum load of the crane rail is not reached by attaining a maximum stress, but rather by coming to a maximum allowable deflection of the crane rail. Beyond maximum deflection, the load will tend to roll downhill and there will be a perceptible effort in order to pull the load uphill. In the present invention, the first bridge reinforcement member 36 spreads out support over more of the midsection of the bridge rail 24, which provides for less deflection of the bridge rail 24 under load, especially near the center of the rail, which permits applying larger loads compared to prior art crane rails before the maximum allowable deflection is reached.

In another advantage, adjustment of the first bridge reinforcement member 36 rather than adjustment of the two second bridge reinforcement members 38 may be utilized to adjust the amount of pre-loading and therefore the extent of upward deflection of the bridge rail 24. In prior art crane rails, adjusting the amount of pre-loading required adjusting the positions of the brackets that secured far ends of the second bridge reinforcement members to the crane rail. In the prior art, adjusting the brackets requires two operators, one at each end of the crane rail, each operator independently moving respective brackets in a relatively uncoordinated manner. As a result, the brackets are prone to being moved by differing distances, which would result in movement and off-centering of the upper end of the first bridge reinforcement member, compromising the ability of the crane to handle loads and providing uneven stresses on the reinforcement members during use of the crane.

Figure 8A:
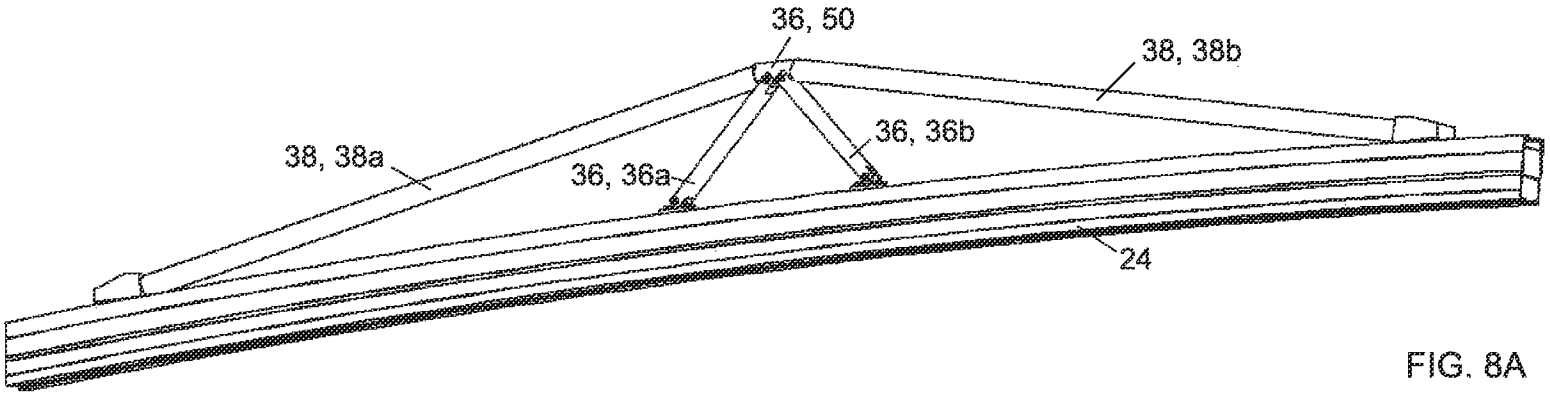
FIG. 8A is a schematic drawing of the bridge rail shown in FIG. 2 deflected upwardly with a first bridge reinforcement member under tension.
Figure 8B:
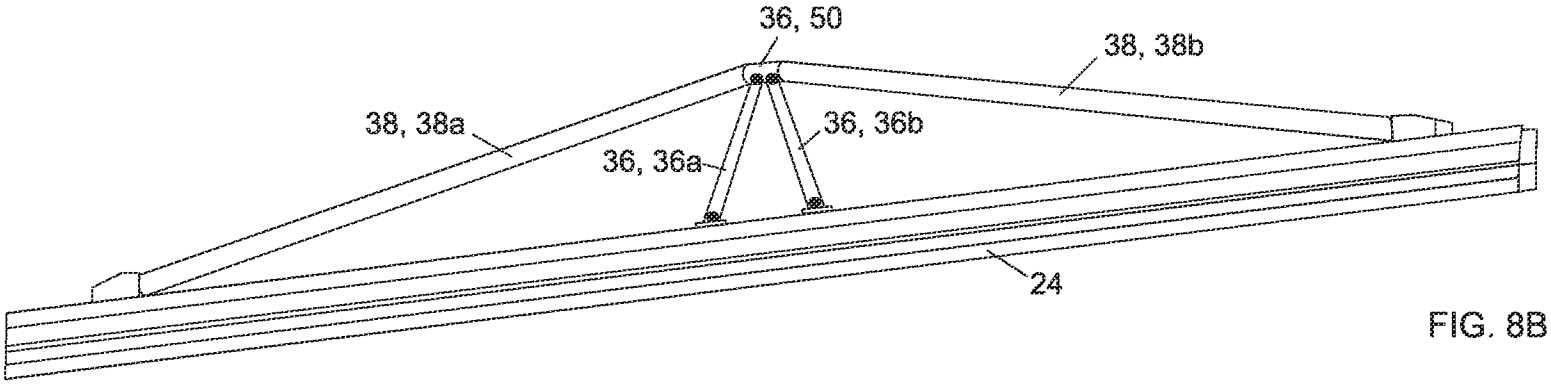
FIG. 8B is a schematic drawing of the bridge rail shown in FIG. 2 with a first bridge reinforcement member under less tension than shown in FIG. 8A.

In the present structure, the mechanical fasteners 46, the pins 45 and the pins 41 may be loosened without removal to permit the support flanges 42 together with the clamping plates 47 to translate longitudinally within the slot 51, and to permit the struts 36*a* and 36*b* to pivot around the pins 41 and 45. With the mechanical fasteners 46 and the pins 41 and 45 loosened but in place, the lower ends 44 of the struts 36*a* and 36*b* may be separated farther apart or brought closer together, followed by retightening of the mechanical fasteners 46 and the pins 41 and 45. As seen in FIG. 8A and FIG. 8B in an exaggerated manner to illustrate principles, separating the lower ends 44 of the struts 36*a* and 36*b* pulls the bridge rail 24 upward thereby increasing pre-loading tension on the first bridge reinforcement member 36 thereby increasing upward deflection of the bridge rail 24, permitting the bridge rail 24 to support greater loads (see FIG. 8A). Bringing the lower ends 44 of the struts 36*a* and 36*b* closer together decreases pre-loading tension on the first bridge reinforcement member 36 thereby decreasing upward deflection of the bridge rail 24 (see FIG. 8B). The ability to finely move the lower ends 42 of the struts 36*a* and 36*b* longitudinally along the bridge rail 24 with respect to each other and with respect to the common upper end 50 of the first bridge reinforcement member 36 advantageously permits fine adjustment of the amount of pre-loading and upward deflection on the bridge rail 24. Because the struts 36*a* and 36*b* are relatively closer together and more easily moved than the brackets 54 holding the two second bridge reinforcement members 38 to the bridge rail 24, a single operator may adjust the struts 36*a* and 36*b* individually or simultaneously in a coordinated manner to ensure that the lower ends 44 of the struts 36*a* and 36*b* are moved the same distance to provide symmetry in position with respect to the position of the common upper end 50 of the first bridge reinforcement member 36 without causing the common upper end 50 to move.

In yet another advantage, transverse horizontal deflection on opposite sides of the first bridge reinforcement member 36 when the bridge rail 24 is placed under load is unexpectedly reduced in comparison to prior art crane rails. In prior art crane rails, loading the bridge rail produces twisting at the joint between the second bridge reinforcement members, and twisting of the first reinforcement member. The limit of the capacity of such crane rails is reached when the second bridge reinforcement members begin to buckle. Typically, one second reinforcement member will buckle out in one direction and the other will buckle out in the opposite direction. Viewed from above, the second reinforcement members begin to form an S-shape, with the first reinforcement member significantly twisted. In the present invention, such buckling and twisting is minimized or prevented, allowing higher loads to be supported before the onset of buckling, allowing a reduction in size (and weight) of the second reinforcement members, and allowing for longer crane spans to be used.

The angle A (see FIG. 8) between the struts 36*a* and 36*b* may have a significant impact on the ability to resist deflections under load. As the angle A approaches 0° or approaches 180°, deflections become more of a problem. For best results, the angle A is preferably in a range of about 40° to about 90°.

Figure 10:
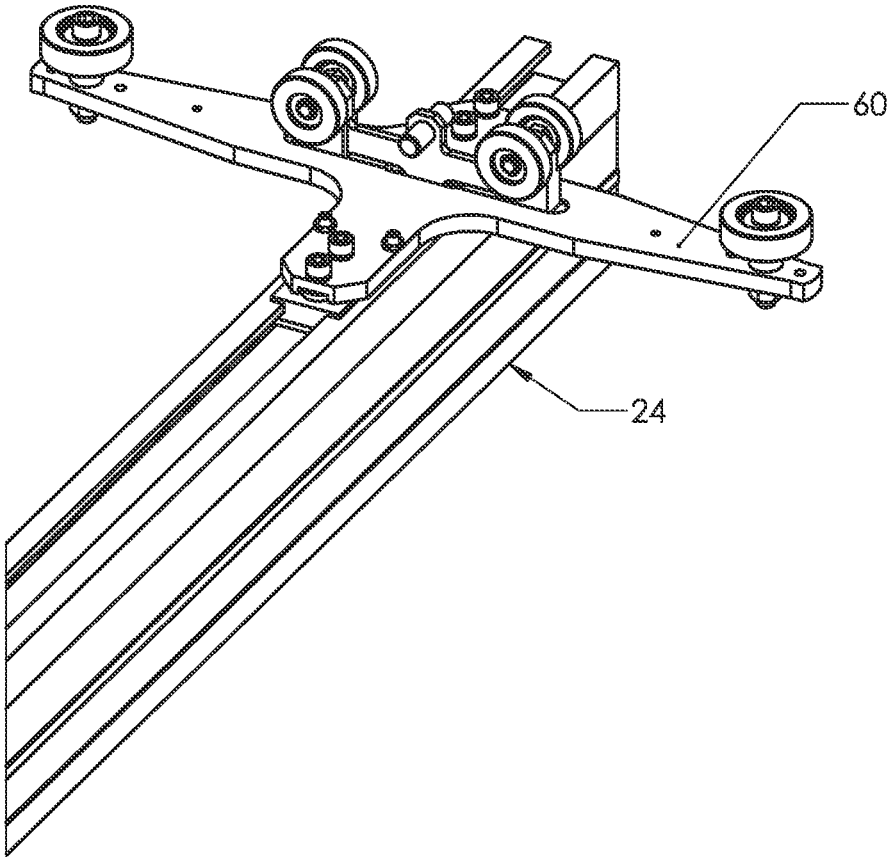
FIG. 10 is a magnified perspective view of an end of the bridge rail shown in FIG. 2 and an end of a runway rail shown in FIG. 2.

Referring to FIG. 10, the bridge 14 further includes a rolling structure 60 mounted at each end of the bridge rail 24 by clamping the upper flanges 49, in similar fashion to the clamping of the flanges 49 by the first member 36 and by the brackets 54. The rolling structure 60 rolls along flanges shown at 62 on the runway rails 20.

The trolley 16 may be made substantially from aluminum. Other materials may also be used in addition to or instead of aluminum.

The lifting device 18 may be a hoist or may be some other suitable type of lifting device.

Referring to FIG. 2, the runway rails 20 may be made similarly to the bridge rail 24 in that they each include flanges 62 that define a track 63. Each runway rail 20 may further be strengthened by a reinforcement structure 72 which increases the bending resistance of the runway rail 20 so as to resist bending forces from the bridge 14. In the exemplary embodiment shown in FIG. 2, the reinforcement structure 72 comprises a first runway reinforcement member 78 which extends upwardly from the runway rail 20, and two second reinforcement members 80 which extend between a common upper end of the first member 78 and the runway rail 20 proximate ends 76*a* and 76*b* of the runway rail 20.

The first runway reinforcement member 78 comprises two struts 78*a* and 78*b* connected together at a common upper end of the runway reinforcement member 78. Lower ends of the struts 78*a* and 78*b* may be mounted to the runway rail 20 at longitudinally spaced apart positions on the runway rail 20. The struts 78*a* and 78*b* form an inverted V-shape between the upper end of the first runway reinforcement member 78 and the runway rail 20. The first runway reinforcement member 78 may be designed in a similar manner as the first bridge reinforcement member 36.

By strengthening the bending resistance of the runway rail 20 in this way, the runway rail 20 itself may be made smaller than it would need to be if the reinforcement structure 72 were omitted. As a result, the overall weight and cost of the runway rail 20 may be reduced relative to a runway rail that did not have a reinforcement structure thereon. It will be noted, however, that reducing the weight of the runway rail, while advantageous, does not facilitate the movement of a lifted load to a destination point, since the runway rails 20 remain fixed in place throughout any operation with the overhead crane. The runway rails 20 may be made from any suitable material, such as steel, or aluminum.

Figure 12:
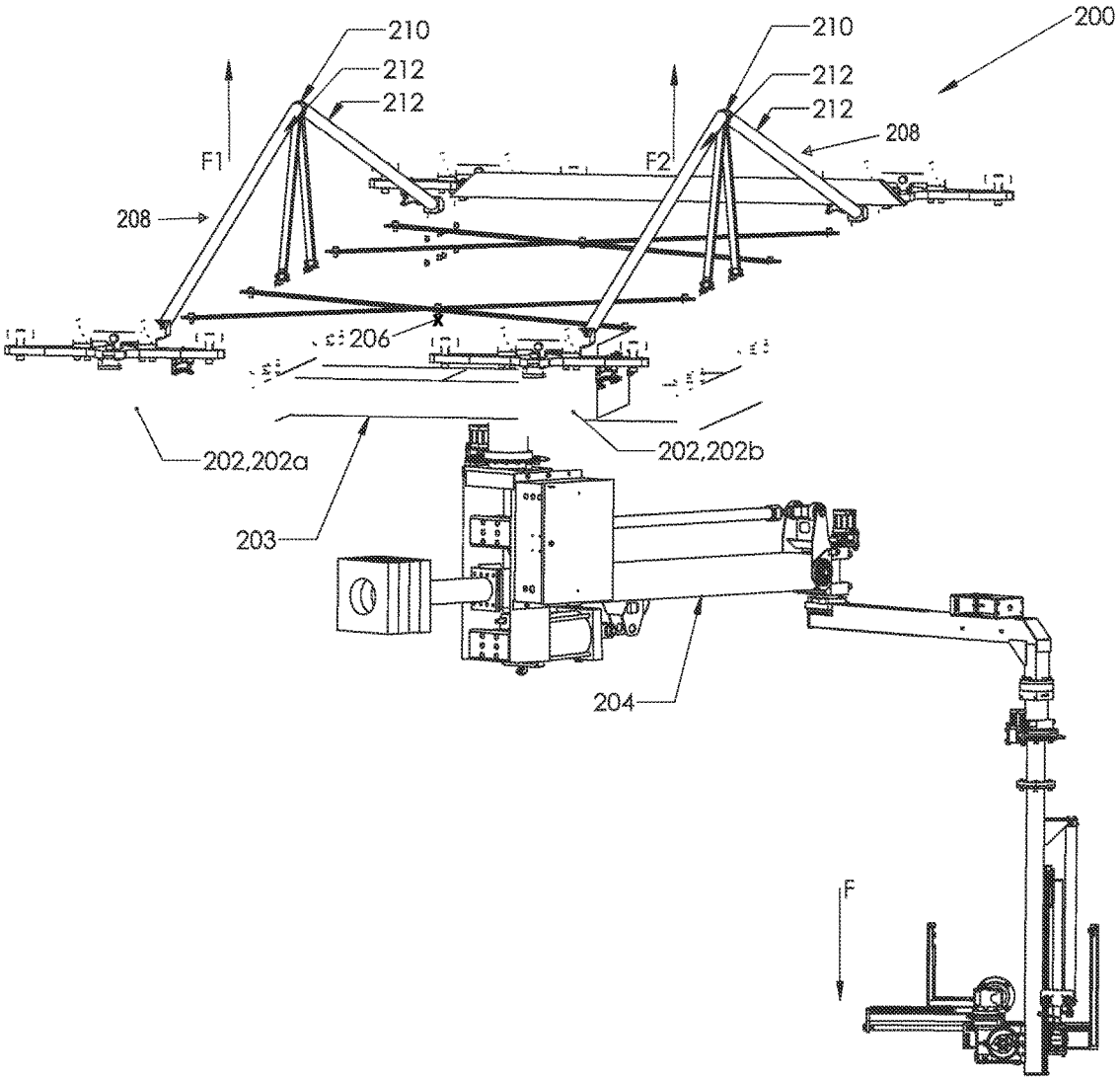
FIG. 12 is a magnified perspective view of the double rail bridge shown in FIG. 11 supporting a carriage and a manipulator.

Reference is made to FIG. 11, which shows a double rail bridge 200 which can be used as part of the overhead crane 10 instead of the single rail bridge 14 (FIG. 2). The double rail bridge 200 has first and second bridge rails 202 (shown individually at 202*a* and 202*b*), which together support a trolley 203 that may hold a lifting device such as a manipulator 204. During use of the manipulator 204 forces may be applied to the bridge 200 that are laterally offset from the longitudinal centerline of the bridge 200 (which is shown at 206 as a point x in FIG. 12). An exemplary offset force is shown at F. The force F generates reaction forces F1 and F2 on the bridge 200. As shown, the force F generates an upwardly directed force F1 on the bridge rail 202*a* and a downwardly directed force F2 on the bridge rail 202*b*. Each bridge rail 202 has a reinforcement structure 208 thereon that includes a first bridge reinforcement member 210 and two second reinforcement members 212. The first bridge reinforcement member 210 may comprise two struts 210*a* and 210*b* connected at a common upper end and mounted on the bridge rail 202 at longitudinally spaced apart positions. Brackets 214 may be provided to connect the second ends of the second reinforcement members 212 to the bridge rail 202. The first and second bridge reinforcement members 210 and 212 are the same as previously described for the embodiment shown in FIG. 2.

It will be noted that, for the bridge rail 202*a*, the first reinforcement member 210 is under compression and the two second reinforcement members 212 are under tension. Conversely, the first reinforcement member 210 on the second bridge rail 202*b* is under tension and the second reinforcement members 212 on the second bridge rail 202*b* are under compression, in similar manner to the single rail bridge 14 shown in FIG. 2. It will be understood that in situations during use of the crane 200, the manipulator 204 may be positioned on the other side of the centerline 206 and so the tension and compression in the members of the reinforcement structures 208 on the two bridge rails 202*a* and 202*b* will be reversed.

Figure 13:
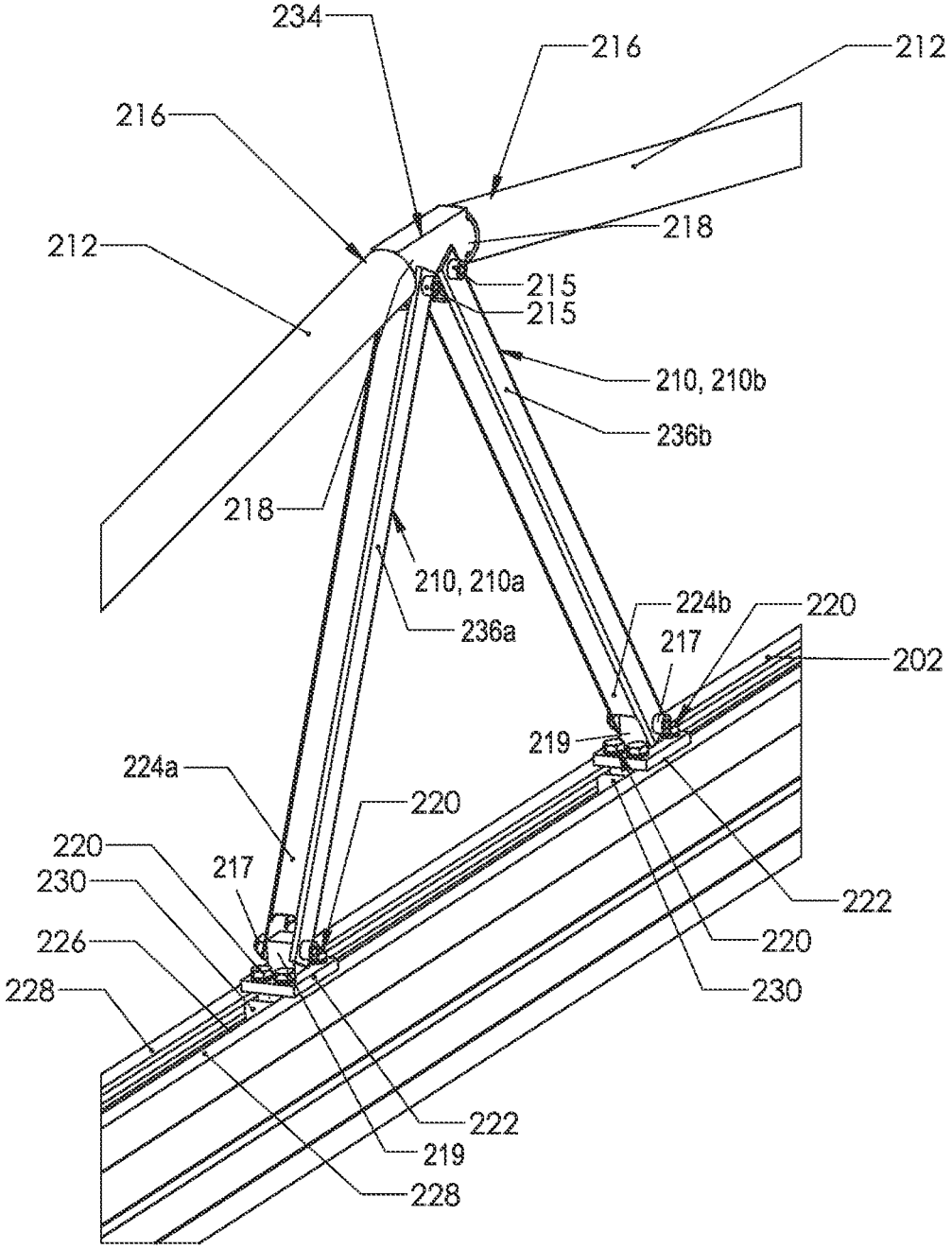
FIG. 13 is a magnified perspective view of a portion of one of the bridge rails shown in FIG. 11.

Referring to FIG. 13, the first reinforcement member 210 may be mounted to the bridge rail 202 in any suitable way, such as by use of one or more threaded fasteners 220 that pass through support flanges 222 at bottom ends 224*a* and 224*b* of the struts 210*a* and 210*b*, respectively, of the first reinforcement member 210. The threaded fasteners 220 pass through a slot 226 between first and second reinforcement support flanges 228 on the bridge rail 202, and pass into a threaded aperture in clamping plates 230 so that the support flanges 222 and the clamping plates 230 together clamp the flanges 228 on the bridge rail 202.

Referring to FIG. 13 still, an upper block 234 of the first reinforcement member 210 comprises mounting posts 218 thereon for receiving and retaining first ends 216 of the second reinforcement members 212. The first ends 216 of the second reinforcement members 212 may comprise apertures within which the mounting posts 218 are seated.

The upper block 234 may be connected to the main bodies shown at 236*a* and 236*b* of struts 210*a* and 210*b*, respectively, of the first reinforcement member 210 by retaining pins 215, for example threaded fasteners such as bolt and nut fasteners. The struts 210*a* and 210*b* may be mounted on respective support flanges 222 with pins 217, for example threaded fasteners such as bolt and nut fasteners, that pass through lower ends of the struts 210*a* and 210*b* and through respective mounting blocks 219 fixedly attached to the support flanges 222. In a similar manner as described previously, the threaded fasteners 220, retaining pins 215 and pins 217 may be loosened to permit movement of the lower ends of the struts 210*a* and 210*b* along the bridge rail 202.

Figure 14:
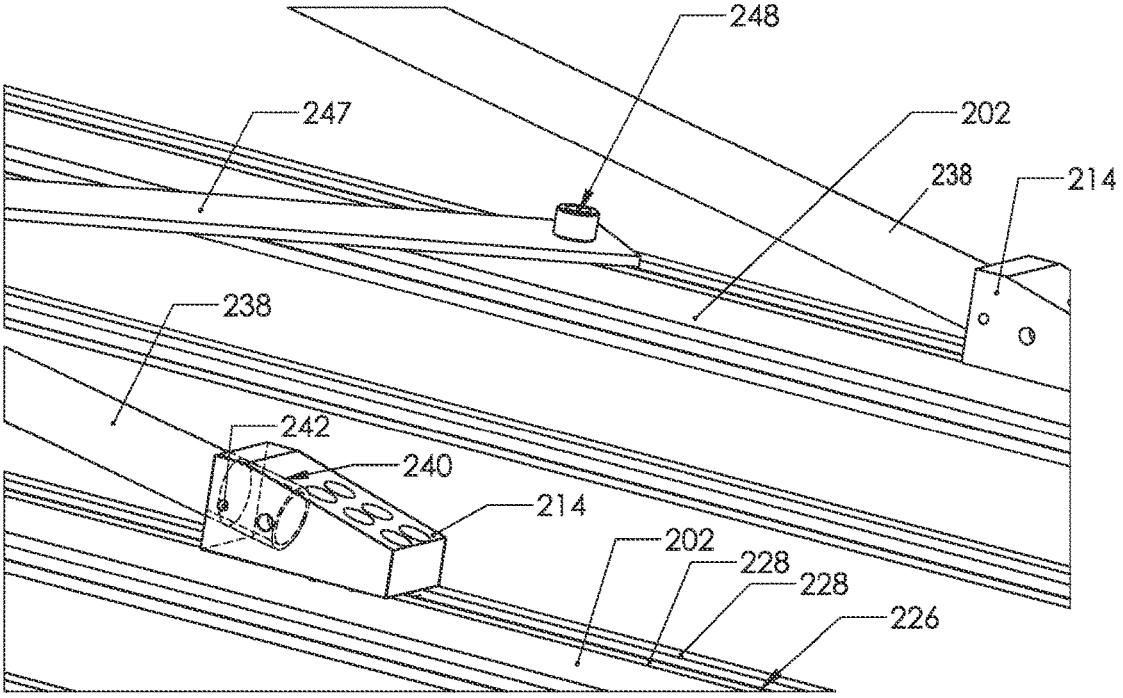
FIG. 14 is a magnified perspective view showing the mounting of one of the second reinforcement members shown in FIG. 11 to one of the bridge rails shown in FIG. 11.

Referring to FIG. 14, each second reinforcement member 212 has a second end 238 that extends into a bracket receiving aperture 240 in one of the brackets 214. A laterally extending second end retaining pin 242 extends laterally through the bracket 214 and through the second end 238 of the second reinforcement member 212. The pin 242 may be any suitable type of pin, such as a spring pin.

Figure 14A:
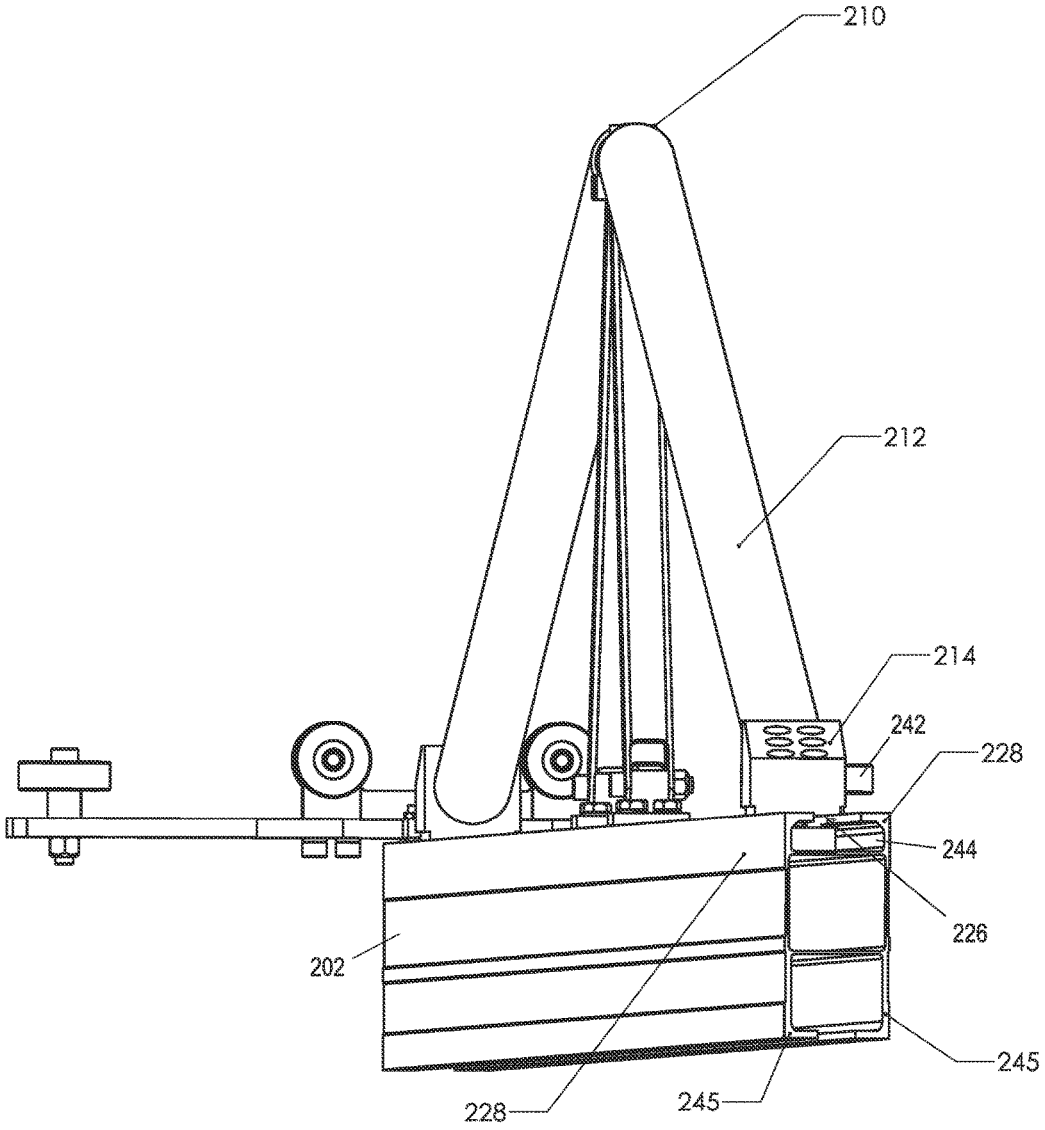
FIG. 14A is a magnified perspective view further showing the mounting of the second reinforcement member shown in FIG. 14 to a bracket, which is mounted to the bridge rail shown in FIG. 14.

Referring to FIG. 14A, each bracket 214 may connect to the bridge rail 202 by means of mechanical fasteners which pass vertically through the bracket 214, through the slot 226 between the upper flanges 228 on the bridge rail 202, and into a threaded aperture in a clamping plate 244 so as to clamp the flanges 228.

As can be seen in FIG. 14A, the bridge rails 202 may each have a similar profile to the bridge rail 24. The bridge rails 202 may have any suitable profile, such as any of the profiles shown in FIG. 3 and FIG. 7. The bridge rails 202 may thus have track flanges 245, which are similar to the track flanges 32 and which together define a track.

Figure 15:
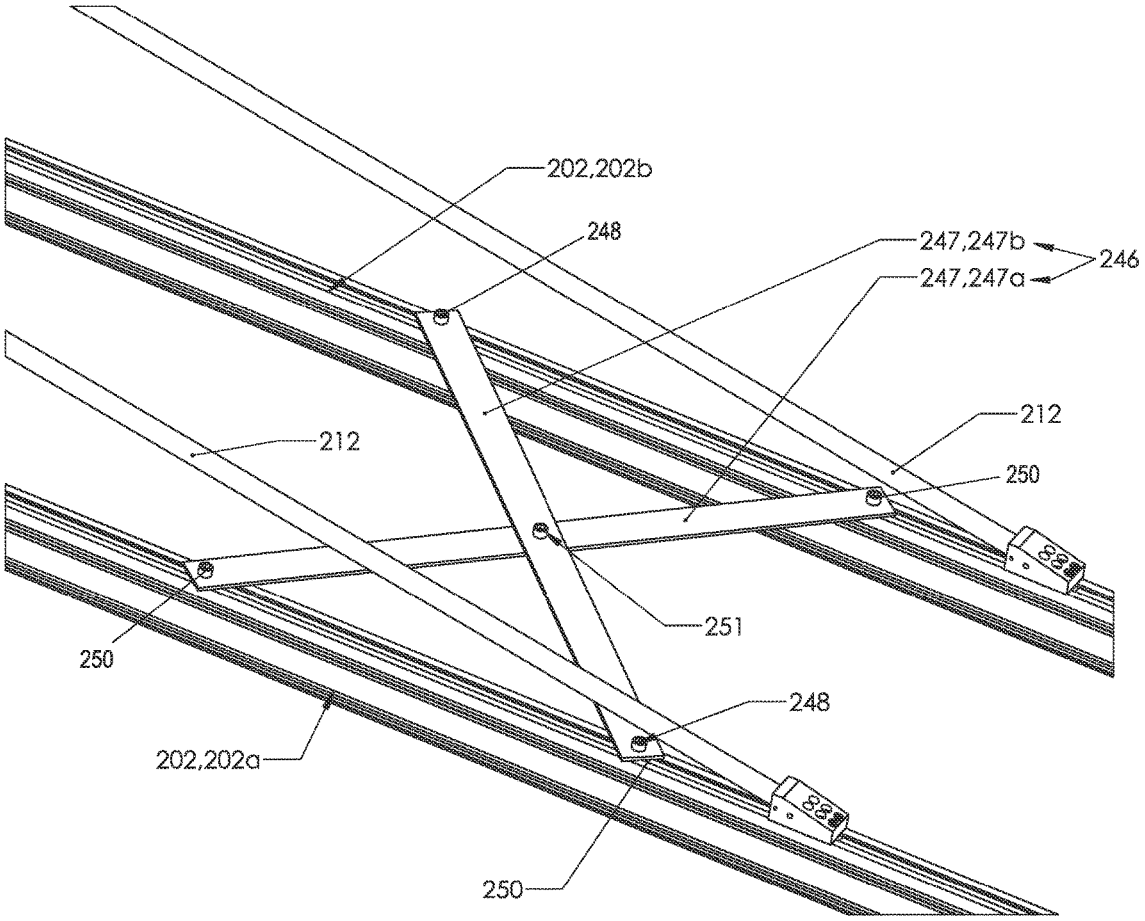
FIG. 15 is a magnified perspective view of the double rail bridge showing the connection between the first and second bridge rails.

Referring to FIG. 11 and FIG. 15, one or more X-bracing structures 246 may be provided between the first and second bridge rails 202*a* and 202*b* so as to structural connect them. Each X-bracing structure 246 may be made up of first and second cross members 247, shown individually at 247*a* and 247*b*. Each cross member 246 may be connected at its ends to the bridge rails 202 by means of threaded fasteners and clamping plates at shown at 248 and 250 in FIG. 15. The cross members 247*a* and 247*b* are also connected to each other at their respective middles by pin connection 251.

Referring to FIG. 11, each of the bridge rails 202 has a rolling structure 252 at each end that may be similar to the rolling structure 60 (FIG. 10).

It will be noted that the reinforcement structures 35 and 208 can easily be retrofitted to existing bridge rails 24, 202 in an existing overhead crane 10, 200, particularly where the overhead crane has upper flanges that can be used as reinforcement support flanges. As a result, the bridge rails can be strengthened significantly so as to be capable of supporting increased loads. It will further be noted that the reinforcement can be provided by the structure 35, 208 without the need for welding elements to the rails 24, 202, without drilling through the rails 24, 202 and without requiring an inordinate number of fasteners.

It is optionally possible to provide the retaining pins 215 and 242 on a single rail bridge, such as the bridge 14, for use in situations where the single rail bridge 14 will be subjected to upward forces from the lifting member.

The novel features will become apparent to those of skill in the art upon examination of the description. It should be understood, however, that the scope of the claims should not be limited by the embodiments, but should be given the broadest interpretation consistent with the wording of the claims and the specification as a whole.

The invention claimed is:

1. An overhead crane, comprising:

first and second runway rails that extend parallel to a generally horizontal runway axis;

a bridge that extends along a bridge axis that is generally horizontal and perpendicular to the runway axis and that is movable on the runway rails along the runway axis, wherein the bridge includes a bridge rail having first and second ends and rolling structures at the first and second ends which are rollably supported on the first and second runway rails;

a trolley having a plurality of trolley wheels thereon permitting movement of the trolley along the bridge rail; and a lifting device for holding a load, wherein the lifting device is supported by the trolley, wherein the bridge further includes a first bridge reinforcement member pre-loaded under tension to provide an upward deflection of the bridge rail, the first bridge reinforcement member comprising at least two upwardly extending struts and a common upper end where the at least two struts meet, the at least two struts having lower ends mechanically connected to the bridge rail at positions longitudinally spaced apart with respect to the bridge axis, the lower ends of the at least two struts longitudinally translatable along the bridge rail to adjust the tension on the first bridge reinforcement member to thereby adjust the extent of upward deflection of the bridge rail, a single pair of second bridge reinforcement members extending between the upper end of the first bridge reinforcement member and mechanically connected to the bridge rail proximate the first and second outer ends, the second bridge reinforcement members loaded in compression, and the bridge reinforcement members providing the greatest increase in bending strength at the longitudinal center of the bridge rail.

2. The overhead crane as claimed in claim 1, wherein the at least two upwardly extending struts are secured to the common upper end by first loosenable connectors that permit the struts to pivot at the connectors when the connectors are loosened, and the at least two upwardly extending struts are mechanically connected to the bridge rail by second loosenable connectors that permit the struts to translate along the bridge rail and pivot at the connectors when the connectors are loosened.

3. The overhead crane as claimed in claim 1, wherein the upper end of the first bridge reinforcement member is substantially over a longitudinal center of the bridge rail.

4. The overhead crane as claimed in claim 1, wherein the at least two struts is two struts, and the two struts form an angle in a range of about 40° to about 90° at the common upper end where the at least two struts meet.

5. The overhead crane as claimed in claim 1, wherein for each runway rail, the runway includes a first runway reinforcement member extending upwardly from the runway rail, the first runway reinforcement member having a lower end connected to the runway rail, and an upper end, and two second runway reinforcement members extending between the upper end of the first runway reinforcement member and the runway rail proximate the first and second outer ends.

6. The overhead crane as claimed in claim 5, wherein the first runway reinforcement member is pre-loaded under tension to provide an upward deflection of the runway rail, and wherein the first runway reinforcement member comprises at least two upwardly extending runway reinforcement struts and a runway reinforcement member common upper end where the at least two runway reinforcement struts meet, the at least two runway reinforcement struts having runway reinforcement lower ends mechanically connected to the runway rail at positions longitudinally spaced apart with respect to the runway axis.

7. The overhead crane as claimed in claim 1, wherein the first bridge reinforcement member has first and second opposed first member receiving apertures at the upper end, and wherein the bridge rail further includes first and second brackets positioned respectively at the first and second outer ends of the bridge rail, each bracket having a bracket receiving aperture that generally faces one of the first member receiving apertures, and wherein each second bridge reinforcement member has a first end that extends into one of the first member receiving apertures and a second end that extends into the bracket receiving aperture on one of the brackets.

8. The overhead crane as claimed in claim 7, wherein the first end of each second bridge reinforcement member is retained within the first end receiving aperture by a first end retaining pin, and the second end of each second bridge reinforcement member is retained within the second end receiving aperture by a second end retaining pin.

9. The overhead crane as claimed in claim 1, wherein the second bridge reinforcement members are not fastened to the first bridge reinforcement member.

10. An overhead crane, comprising:

first and second runway rails that extend parallel to a generally horizontal runway axis;

a bridge that extends along a bridge axis that is generally horizontal and perpendicular to the runway axis and that is movable on the runway rails along the runway axis, wherein the bridge includes first and second bridge rails that are connected to each other and that are generally parallel, wherein each bridge rail has first and second ends and rolling structures at the first and second ends which are rollably supported on the first and second runway rails;

a trolley that is rollably supported on the first and second bridge rails; and a lifting device for holding a load, wherein the lifting device is supported by the trolley and is capable of lifting loads in such a way as to generate downward forces that are offset laterally from the bridge axis, wherein, for each bridge rail, the bridge further includes a first bridge reinforcement member pre-loaded under tension to provide an upward deflection of the bridge rail, the first bridge reinforcement member comprising at least two upwardly extending struts and a common upper end where the at least two struts meet, the at least two struts having lower ends mechanically connected to the bridge rail at positions longitudinally spaced apart with respect to the bridge axis, the lower ends of the at least two struts longitudinally translatable along the bridge rail to adjust the tension on the first bridge reinforcement member to thereby adjust the extent of upward deflection of the bridge rail, a single pair of second bridge reinforcement members extending between the upper end of the first bridge reinforcement member and mechanically connected to the bridge rail proximate the first and second outer ends, the second bridge reinforcement members loaded in compression, and the bridge reinforcement members providing the greatest increase in bending strength at the longitudinal center of the bridge rail, wherein the first bridge reinforcement member has first and second opposed first member receiving apertures at the upper end, and wherein the bridge rail further includes first and second brackets positioned respectively at the first and second outer ends of the bridge rail, each bracket having a bracket receiving aperture that generally faces one of the first member receiving apertures, and wherein each second bridge reinforcement member has a first end that extends into one of the first member receiving apertures and a second end that extends into the bracket receiving aperture on one of the brackets, wherein the first end of each second bridge reinforcement member is retained within the first end receiving aperture by a first end retaining pin, and the second end of each second bridge reinforcement member is retained within the second end receiving aperture by a second end retaining pin.

11. The overhead crane as claimed in claim 10, wherein the at least two upwardly extending struts are secured to the common upper end by first loosenable connectors that permit the struts to pivot at the connectors when the connectors are loosened, and the at least two upwardly extending struts are mechanically connected to the bridge rail by second loosenable connectors that permit the struts to translate along the bridge rail and pivot at the connectors when the connectors are loosened.

12. The overhead crane as claimed in claim 10, wherein the upper end of the first bridge reinforcement member is substantially over a longitudinal center of the bridge rail.

13. The overhead crane as claimed in claim 10, wherein the at least two struts is two struts, and the two struts form an angle in a range of about 40° to about 90° at the common upper end where the at least two struts meet.

14. A retrofit kit for strengthening an overhead crane, wherein the overhead crane includes first and second runway rails that extend parallel to a generally horizontal runway axis, a bridge that extends along a bridge axis that is generally horizontal and perpendicular to the runway axis and that is movable on the runway rails along the runway axis, wherein the bridge includes a bridge rail having first and second ends and rolling structures at the first and second ends which are rollably supported on the first and second runway rails, a trolley having a plurality of trolley wheels thereon permitting movement of the trolley along the bridge rail, and a lifting device for holding a load, wherein the lifting device is supported by the trolley, wherein the bridge rail includes a pair of track flanges which form a track for the trolley and wherein the bridge rail further includes a second pair of flanges, wherein the retrofit kit includes:

a first bridge reinforcement member pre-loadable under tension to provide an upward deflection of the bridge rail, the first bridge reinforcement member comprising at least two upwardly extending struts and a common upper end where the at least two struts meet, the at least two struts having lower ends mechanically connectable to the bridge rail at positions longitudinally spaced apart with respect to the bridge axis, the lower ends of the at least two struts longitudinally translatable along the bridge rail to adjust the tension on the first bridge reinforcement member to thereby adjust the extent of upward deflection of the bridge rail, a single pair of second bridge reinforcement members extending between the upper end of the first bridge reinforcement member and mechanically connected to the bridge rail proximate the first and second outer ends, the second bridge reinforcement members loaded in compression, and the bridge reinforcement members providing the greatest increase in bending strength at the longitudinal center of the bridge rail, wherein the first bridge reinforcement member is the only first bridge reinforcement member on the bridge rail and wherein the two second bridge reinforcement members are the only two second bridge reinforcement members on the bridge rail, wherein at least one fastener passes through each of the first bridge reinforcement member and brackets and into an associated clamping plate to clamp the second flanges.

15. The retrofit kit as claimed in claim 14, wherein the at least two upwardly extending struts are securable to the common upper end by first loosenable connectors that permit the struts to pivot at the connectors when the connectors are loosened, and the at least two upwardly extending struts are mechanically connectable to the bridge rail by second loosenable connectors that permit the struts to translate along the bridge rail and pivot at the connectors when the connectors are loosened.

16. The retrofit kit as claimed in claim 14, wherein in the upper end of the first bridge reinforcement member is substantially over a longitudinal center of the bridge rail.

17. The retro fit as claimed in claim 14, wherein the at least two struts is two struts, and the two struts form an angle in a range of about 40° to about 90° at the common upper end where the at least two struts meet.

18. A bridge or runway for an overhead crane, the bridge or runway comprising:

a rail;

a first reinforcement member pre-loaded under tension to provide an upward deflection of the rail, the first reinforcement member comprising at least two upwardly extending struts and a common upper end where the at least two struts meet, the at least two struts having lower ends mechanically connected to the rail at positions longitudinally spaced apart with respect to a longitudinal axis of the rail, the lower ends of the at least two struts longitudinally translatable along the rail to adjust the tension on the first reinforcement member to thereby adjust the extent of upward deflection of the rail; and, a single pair of second reinforcement members extending between the upper end of the first reinforcement member and mechanically connected to the rail proximate first and second outer ends, the second reinforcement members loaded in compression.

19. The bridge or runway as claimed in claim 18, wherein the at least two upwardly extending struts are secured to the common upper end by first loosenable connectors that permit the struts to pivot at the connectors when the connectors are loosened, and the at least two upwardly extending struts are mechanically connected to the bridge rail by second loosenable connectors that permit the struts to translate along the bridge rail and pivot at the connectors when the connectors are loosened.

20. The bridge or runway as claimed in claim 18, wherein the at least two struts is two struts, and the two struts form an angle in a range of about 40° to about 90° at the common upper end where the at least two struts meet.

* * * * *